US007088842B2

(12) United States Patent
Hikichi

(10) Patent No.: US 7,088,842 B2
(45) Date of Patent: Aug. 8, 2006

(54) SPEAKER APPARATUS

(75) Inventor: Toshihiro Hikichi, Yamagata-ken (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 170 days.

(21) Appl. No.: 10/785,003

(22) Filed: Feb. 25, 2004

(65) Prior Publication Data

US 2004/0170297 A1 Sep. 2, 2004

(30) Foreign Application Priority Data

Feb. 27, 2003 (JP) ..... 2003-051543

(51) Int. Cl.
*H04R 25/00* (2006.01)

(52) U.S. Cl. ..... 381/430; 381/398

(58) Field of Classification Search ..... 381/386, 381/396, 398, 423, 424, 430; 181/163–165, 181/171–173

See application file for complete search history.

(56) References Cited

U.S. PATENT DOCUMENTS 2,974,204 A * 3/1961 Supitilov ..... 381/430
6,490,363 B1 * 12/2002 Liu ..... 381/430
6,636,612 B1 * 10/2003 North et al. ..... 381/398

FOREIGN PATENT DOCUMENTS

JP 54-1242 12/1974
JP 11-088987 3/1990

* cited by examiner

*Primary Examiner*—Suhan Ni
(74) *Attorney, Agent, or Firm*—Arent Fox PLLC

(57) ABSTRACT

It is an object of the invention to provide an improved speaker apparatus which maintains the advantages as an inverted dome speaker and has a good directivity and a thin thickness, as well as a broad playback frequency band extending from a high frequency band to a low frequency band. The speaker apparatus includes a dome diaphragm carrying a voice coil and having a concave cross section protruding towards the voice coil, an edge provided on the outer periphery of the dome diaphragm, having a concave cross section protruding towards the voice coil, and supporting the dome diaphragm on a frame, and a magnetic circuit forming a magnetic gap containing the voice coil. Particularly, the edge has a broad edge width {b=(1.5–3)a} bearing a lower playback frequency band than a playback frequency band born by the dome diaphragm.

5 Claims, 3 Drawing Sheets

SPEAKER APPARATUS

BACKGROUND OF THE INVENTION

The present invention relates to a speaker apparatus.

The present application claims priority from Japanese Application No. 2003-051543, the disclosure of which is incorporated herein by reference.

The basic configuration of a conventional dome speaker is such that it has a dome diaphragm B carrying a voice coil A, as shown in FIG. 1A. The conventional speaker further includes a ring-shaped permanent magnet C1, a top yoke C2, and a yoke C3, thus forming a magnetic circuit (an inner magnetic type). The voice coil A is disposed in an annular magnetic gap formed between the top yoke C2 and the yoke C3, while a frame D is provided around the yoke C3, thereby supporting the dome diaphragm B on its edge E.

The dome diaphragm B shown in FIG. 1A has a cross section protruding towards the front side of the speaker. In this way, the overall height of the speaker extends from the bottom of the yoke C3 to the protruding (top) portion of the dome diaphragm B, hence increasing the overall height (thickness) of the speaker by the protruding portion. In order to produce a thin type speaker so as to solve this problem, there has been suggested an inverted dome speaker having a concave cross section formed by protruding the dome diaphragm B towards the voice coil A, as shown in FIG. 1B and as disclosed in Japanese Utility Model Publication No. 54-1242 and Japanese Unexamined Patent Application Publication No. 11-88987.

It is known that the above-mentioned inverted dome speaker generally has a high directivity, and since the dome diaphragm curves continuously with different radiuses, it is allowed to obtain an advantage that high frequency band resonance may be dispersed, thereby increasing a resonance frequency in high frequency band and obtaining a flat sound-pressure frequency characteristic in high frequency band. For this reason, such kind of dome speaker is generally used as a loud-sound playback speaker (tweeter) by taking advantage of such high frequency band characteristic.

Moreover, since the inverted dome speaker mentioned above is formed such that its high frequency band characteristic can be controlled by driving an optimal position of the diaphragm, it is allowed to further improve its directivity as compared with a non-inverted dome speaker having the same diameter. In addition, since a high structural stability and high structural rigidity may be acquired by virtue of the concave cross-section of the diaphragm, it is possible to increase a divisional vibration frequency and to suppress a distortion in a middle-sound band. Besides, by forming the diaphragm having a shallow concave cross section, it is permitted to ensure an improved speaker performance capable of avoiding a front-room-effect (which is a turbulence of a sound-pressure characteristic usually caused by hollow portion on the front side of diaphragm).

In this way, an inverted dome speaker can usually be made thinner in its thickness and more excellent in its high frequency characteristic and directivity than a cone type speaker. However, in order to inhibit a characteristic irregularity caused by a reverse resonance between dome diaphragm and edge, it is desired that edge width (edge outer diameter) be made as small as possible. As a result, a dome diaphragm usually has an effective vibration area located only inside the dome diaphragm. Consequently, various dome speaker apparatuses including such an inverted dome speaker are usually unsuitable for low-frequency band playback. Moreover, since the edge width is narrow, the amplitude range of the diaphragm will be small, thus there has been a problem that this sort of speaker apparatus is not suitable for playback in low frequency band (which usually requires large amplitude).

SUMMARY OF THE INVENTION

The present invention is to solve the aforementioned problem and it is an object of the invention to provide an improved speaker apparatus having the above-discussed advantages of an inverted dome speaker which has a good directivity, is allowed to have a thin thickness, and has a broad playback frequency band extending from a high frequency band to a low frequency band.

In order to achieve the above object, there is provided a speaker apparatus comprising: a dome diaphragm equipped with a voice coil and having a concave cross section protruding towards the voice coil; an edge provided on the outer periphery of the dome diaphragm, having a concave cross section protruding towards the voice coil, and supporting the dome diaphragm on a frame; and a magnetic circuit forming a magnetic gap containing the voice coil. Specifically, the edge has an edge width bearing a lower playback frequency band than a playback frequency band born by the dome diaphragm.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENT

Figure 1A:
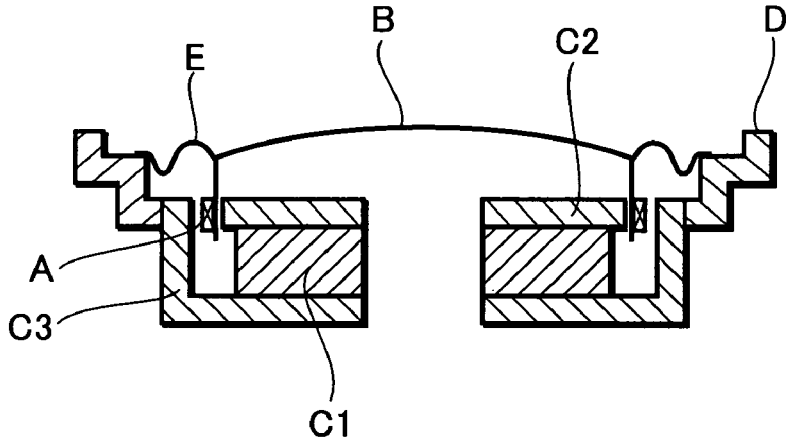
FIG.1 A PRIOR ART
FIGS. 1A and 1B are cross sectional views showing conventional speaker apparatuses.
Figure 1B:
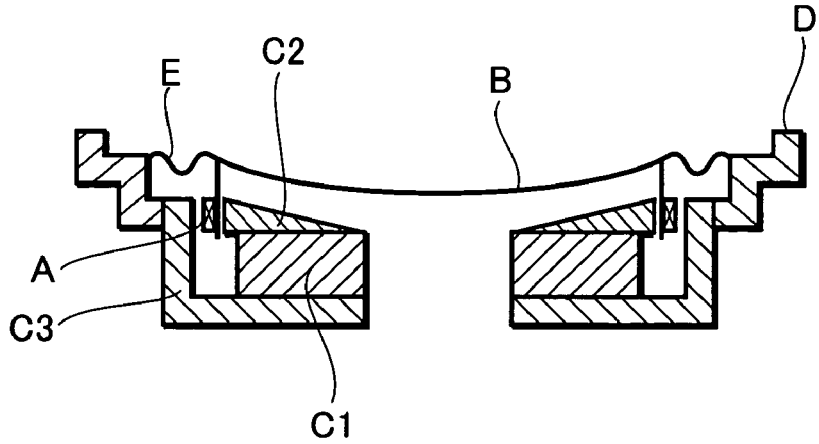
Figure 2:
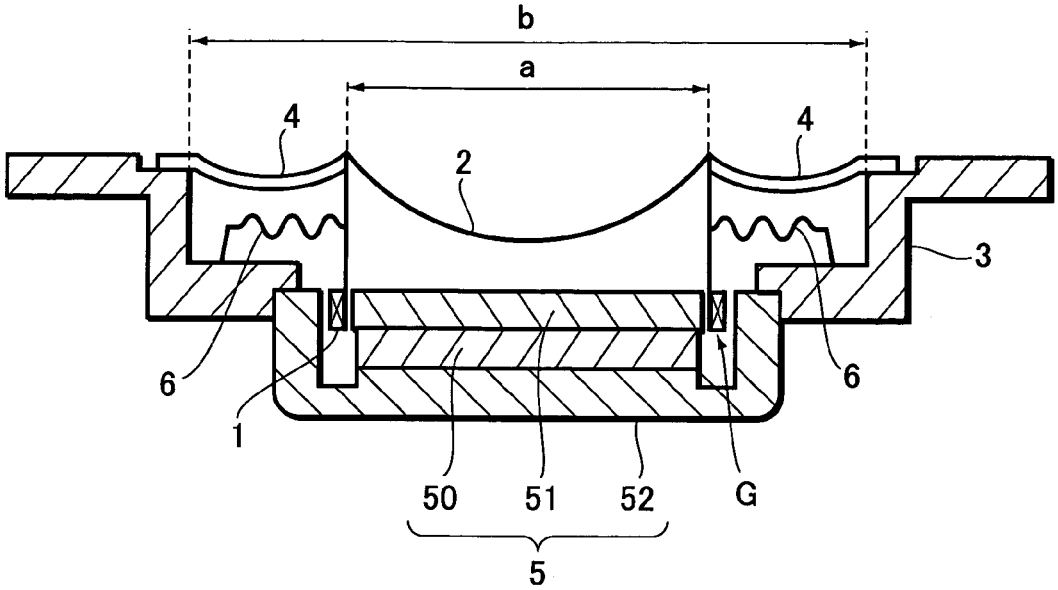
FIG. 2 is a cross sectional view schematically showing the constitution of a speaker apparatus according to an embodiment of the present invention.

An embodiment of the present invention will be described in the following with reference to the accompanying drawings. FIG. 2 is an explanatory view (substantially a cross sectional view) showing the constitution of a speaker apparatus formed according to one embodiment of the invention. As shown, the speaker apparatus comprises a dome diaphragm 2 carrying a voice coil 1, an edge 4 supporting the dome diaphragm 2 on a frame 3, a magnetic circuit 5 consisting of a permanent magnet 50, a top yoke 51, and a yoke 52. The voice coil 1 is disposed in a magnetic gap G formed by the magnetic circuit 5. If necessary, a suspension 6 is provided for supporting the dome diaphragm 2 on the frame 3.

Firstly, the speaker apparatus of the present embodiment of the invention is characterized in that the dome diaphragm 2 has a concave cross section protruding towards the voice coil 1 side, the edge 4 provided along the outer periphery of the dome diaphragm 2 also has a concave cross section similar to that of the dome diaphragm 2. Specifically, the edge 4 has a broad width such that it bears a lower playback frequency band than that born by the dome diaphragm 2.

In this way, since the edge 4 has a concave cross section similar to that of the dome diaphragm 2, there is no portion protruding towards the speaker front side. Further, since the dome diaphragm 2 and the edge 4 have shallow depressions, a flat configuration similar to a flat diaphragm can be obtained, thereby making it possible to reduce the overall height of the speaker, thus producing an apparatus having a thin thickness. Moreover, since the dome diaphragm 2 and the edge 4 have been formed to have shallow concave cross sections, it is possible to ensure a structural stability and a high rigidity, thereby increasing a divisional vibration frequency and reducing a middle-sound distortion, thus obtaining a good speaker performance capable of avoiding an undesired front-room effect.

Furthermore, since the width of the edge 4 has been made large, the edge 4 itself has a low frequency band playback characteristic, while the dome diaphragm 2 is allowed to have large amplitude, it is therefore possible to perform a satisfactory low frequency band playback. In this way, along with a satisfactory high frequency band playback characteristic of the dome diaphragm 2, it is possible to ensure a broad playback frequency band. Besides, it is also possible to exhibit a good directivity as an inverted dome speaker.

Secondly, the speaker apparatus is characterized in that the edge outer diameter b is 1.5 to 3 times the edge inner diameter a. If the edge outer diameter b is smaller than 1.5 times the edge inner diameter a, it will be difficult for the dome diaphragm 2 to obtain sufficient amplitude for low frequency band playback, hence making it impossible for the edge itself to obtain a low frequency band playback characteristic. On the other hand, if the edge outer diameter b is larger than 3 times the edge inner diameter a, using a soft material (which allows low frequency band playback) cannot ensure a necessary rigidity required for supporting the dome diaphragm 2, while the using of a hard material can make it difficult to perform a low frequency band playback. Accordingly, as an appropriate edge width for obtaining the aforementioned advantages, it is effective to control the edge outer diameter b within a range which is 1.5 to 3 times the edge inner diameter a, particularly 2 times the edge inner diameter a.

Thirdly, the speaker apparatus is characterized in that the dome diaphragm 2 and the edge 4 are formed by mutually independent members. In this way, along with the aforementioned advantages, it is possible to easily set not only the frequency characteristic of the dome diaphragm 2 which bears a high frequency band playback, but also the frequency characteristic of the edge 4 which bears a low frequency band playback.

Fourthly, the speaker apparatus is characterized in that the dome diaphragm 2 and the edge 4 are formed by different materials. In this way, along with the aforementioned advantages, it is possible to make use of material difference to easily set the frequency characteristic of the dome diaphragm 2 which bears a high frequency band playback, as well as the frequency characteristic of the edge 4 which bears a low frequency band playback.

Fifthly, the speaker apparatus is characterized in that the magnetic circuit of the speaker apparatus is an inner magnetic type. Although the magnetic circuit of the speaker apparatus is allowed to be an outer magnetic type, using an inner magnetic type such as the magnetic circuit 5 shown in FIG. 2 makes it possible to reduce an overall height of a speaker, thereby forming a speaker apparatus having a thin thickness.

Figure 3:
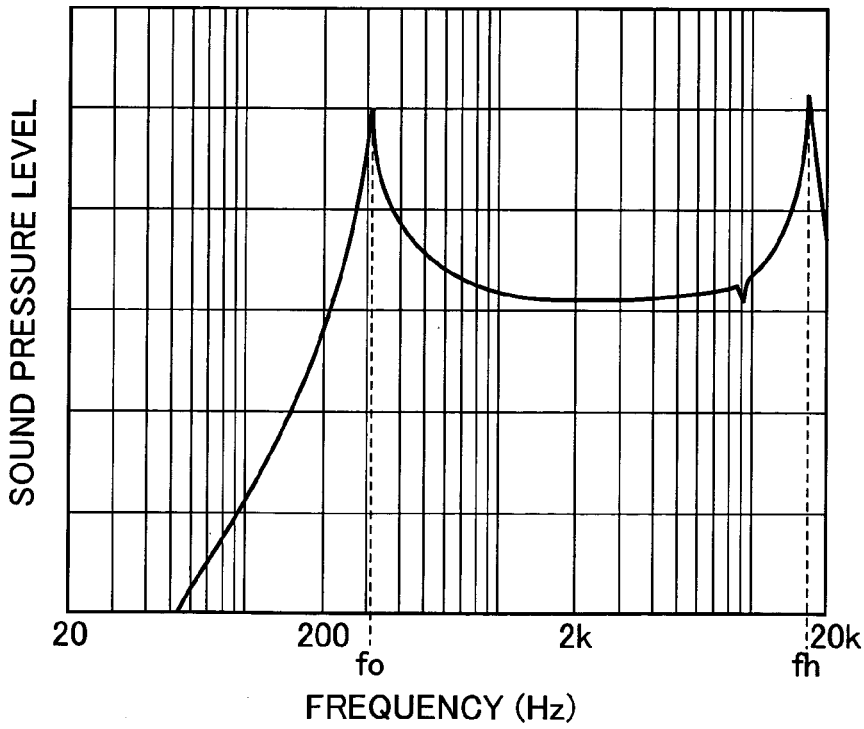
FIG. 3 is a graph showing an analyzed example exhibiting a sound-pressure frequency characteristic of the speaker apparatus according to one embodiment of the present invention.

FIG. 3 is a graph showing an analyzed example of sound-pressure frequency characteristic of the speaker apparatus formed according to the present embodiment. With regard to the speaker apparatus of the present embodiment, it is allowed to use Finite Element Method or the like to decide the material, thickness and curvature configuration (curvature radius R) of the dome diaphragm 2 and the edge 4, in order that various characteristics will not be confused in a desired frequency band. Actually, FIG. 3 shows an analyzed example in which b=2a (a: edge inner diameter; b: edge outer diameter), as decided by Finite Element Method. If it is a commonly used (conventional) dome speaker which is specifically for use in loud-sound playback and whose high frequency band resonance frequency $f_H$ exists near 20 kHz, its low frequency band resonance frequency $f_0$ will be as high as 1 kHz. Different from the conventional speaker apparatus, in the speaker apparatus according to the present embodiment of the present invention, it is possible to reduce the low frequency band resonance frequency to about 400 Hz, as shown in the graph of FIG. 3.

Figure 4A:
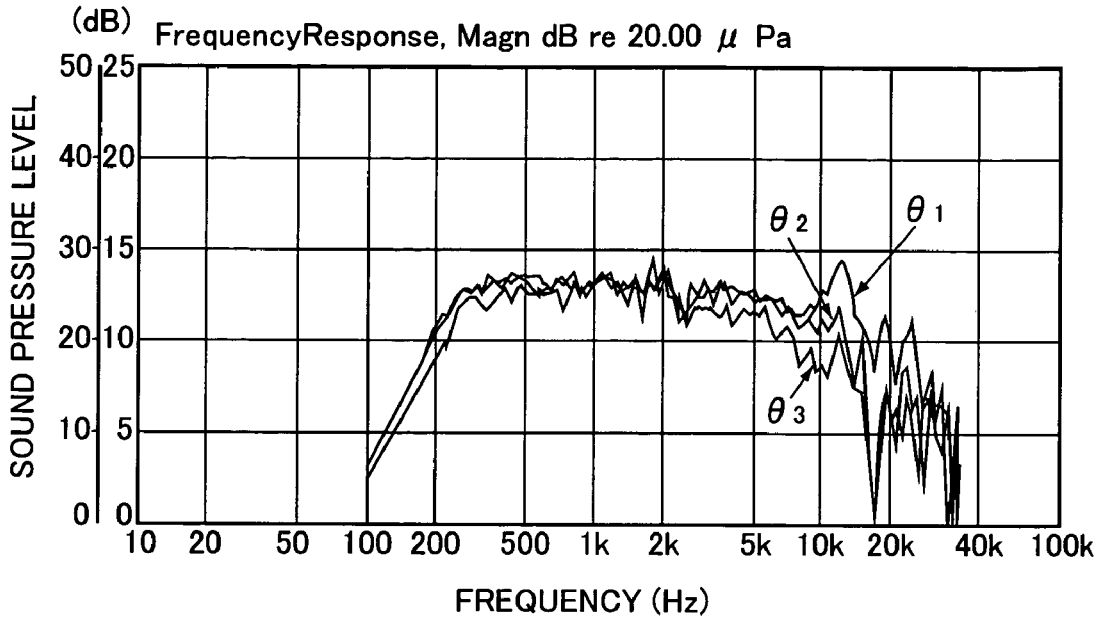
FIGS. 4A and 4B are graphs showing measurement results of sound-pressure frequency characteristics when b=2a (a: edge inner diameter; b: edge outer diameter), with regard to the speaker apparatus according to the embodiment of the invention.
Figure 4B:
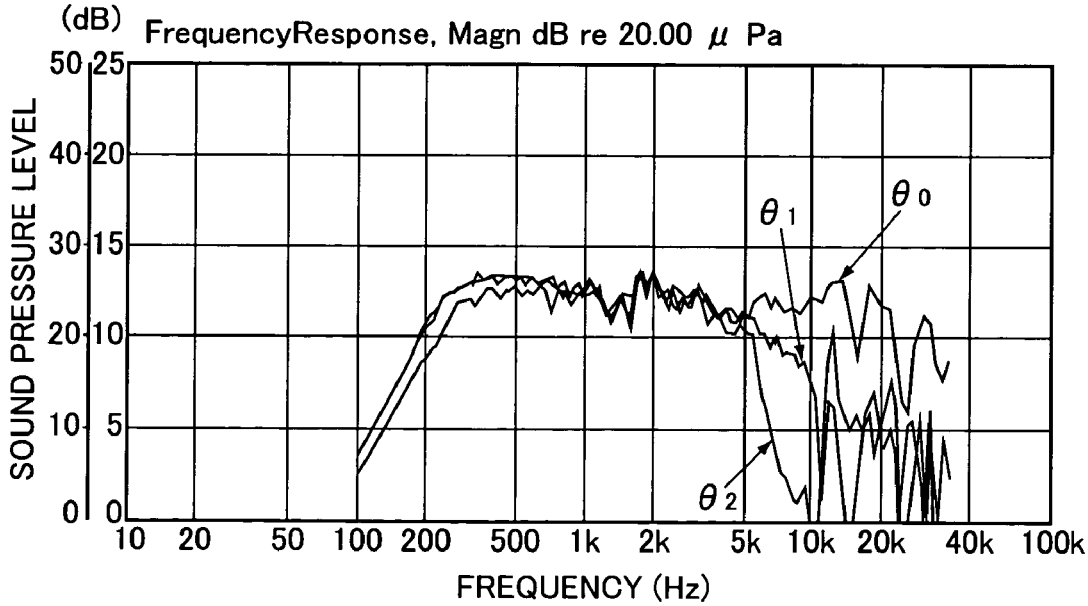

FIGS. 4A and 4B are graphs showing measurement results of sound-pressure frequency characteristic when b=2a (a: edge inner diameter; b: edge outer diameter), with regard to the speaker apparatus according to the present embodiment of the invention. Here, in order to show directivity, the characteristic of each direction ($\theta_0$=0 degrees, $\theta_1$=30 degrees, $\theta_2$=60 degrees) is shown. FIG. 4A shows measurement results of a speaker in which the dome diaphragm 2 and the edge 4 all have concave cross sections, while FIG. 4B shows measurement results of a speaker in which the dome diaphragm 2 and the edge 4 all have convex cross sections. In the case where the dome diaphragm 2 and the edge 4 all have concave cross sections, it is allowed to obtain an almost flat sound-pressure frequency characteristic (irrespective of directions) in a broad frequency band of about 200 Hz–10 kHz, as shown in FIG. 4A. On the other hand, in the case where the dome diaphragm 2 and the edge 4 all have convex cross sections, there is an inclination that the directivity will become worse in a frequency band higher than for example 5 kHz, as shown in FIG. 4B.

As described above, according to the present embodiment of the invention, it is possible to provide an improved speaker apparatus which maintains the advantages as an inverted dome speaker and has a good directivity and a thin thickness, as well as a broad playback frequency band extending from a high frequency band to a low frequency band.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A speaker apparatus comprising:

a dome diaphragm equipped with a voice coil and having a concave cross section protruding towards the voice coil;

an edge provided on the outer periphery of the dome diaphragm, having a concave cross section protruding towards the voice coil, and supporting the dome diaphragm on a frame; and a magnetic circuit forming a magnetic gap containing the voice coil, wherein the edge has an edge width bearing a lower playback frequency band than a playback frequency band born by the dome diaphragm.

2. The speaker apparatus according to claim 1, wherein the outer diameter of the edge is 1.5 to 3 times the inner diameter of the edge.

3. The speaker apparatus according to claim 1, wherein the dome diaphragm and the edge are formed by mutually independent members.

4. The speaker apparatus according to claim 1, wherein the dome diaphragm and the edge are formed by mutually different materials.

5. The speaker apparatus according to claim 1, wherein the magnetic circuit is an inner magnetic type.

* * * * *